US005598993A

United States Patent [19]

Kuhn et al.

[11] Patent Number: 5,598,993

[45] Date of Patent: Feb. 4, 1997

[54] PSEUDO HEAVY POINT FROG ASSEMBLY

[75] Inventors: Stephen R. Kuhn, Richton Park; Keith Young, Naperville, both of Ill.

[73] Assignee: ABC Rail Products Corporation, Chicago, Ill.

[21] Appl. No.: 391,197

[22] Filed: Feb. 21, 1995

[51] Int. Cl.[6] ..... E01B 7/00

[52] U.S. Cl. ..... 246/468; 246/472

[58] Field of Search ..... 246/468, 469, 246/470, 471, 472, 454, 460, 462, 463, 464

[56] References Cited

U.S. PATENT DOCUMENTS

| | | | |
|---|---|---|---|
| 887,847 | 5/1908 | Reinoehl et al. | 246/463 |
| 1,933,139 | 10/1933 | Daley | 246/471 |
| 2,012,807 | 8/1935 | Caruthers | 246/468 |
| 3,755,670 | 8/1973 | Damy | 246/468 |
| 5,496,004 | 3/1996 | Kuhn | 246/470 |

*Primary Examiner*—Mark T. Le
*Attorney, Agent, or Firm*—Thomas S. Baker, Jr.

[57] ABSTRACT

A railroad trackwork frog assembly is provided with a pair of wing rail components, with a centrally positioned body component comprising an integrally formed V-shaped point element having a pair of gauge lines, an integrally formed pair of wing elements having a pair of guard lines, and integrally formed flangeways separating said point element from said pair of wing elements, and with fasteners joining the body component wing elements to the wing rail components in a manner whereby the point element gauge lines are truly parallel to the wing element guard lines and are uniformly separated from said wing element guard lines uniformly by a distance of approximately 1¾-inches.

2 Claims, 2 Drawing Sheets

PSEUDO HEAVY POINT FROG ASSEMBLY

FIELD OF THE INVENTION

This invention relates generally to railroad trackworks, and particularly concerns railroad trackwork frog assemblies which have a greater impact load-bearing capability than functionally equivalent standard frog assemblies having a "heavied" frog point element but which do not include a "heavied" point element in their construction.

BACKGROUND OF THE INVENTION

A railroad frog is an assembly of components or elements which is installed at the intersection of two trackwork running rails to permit the flanges of railroad flanged car wheels moving along one of the running rails to in effect pass across the other running rail without changing the elevation of the car wheel. The frog assembly supports the rim tread surface of each car wheel as it passes from an assembly wing rail component, across a gap-like flangeway element, and onto the frog point component when the wheel is moving in a "facing movement" direction. When moved in an opposite or "trailing movement" direction the tread of the flanged rail car wheel passes from being fully supported by the point element, across the same flangeway, and fully onto the wing rail element. The frog assembly flangeways are each essentially positioned intermediate the assembly point element and a respective one of the assembly wing elements.

It has long been observed that over prolonged periods the railroad industry's standard or conventional trackwork frog assembly, particularly as utilized in mainline turnouts and crossovers subject to high speed and/or heavy traffic, will experience and exhibit a crushing degradation of the frog point element tread surface in that zone where the frog tread surface areas are impacted by wheel loads as rail car wheels are moved and transferred from full support by the frog wing element to full support by the frog point element. To correct the observed deficiency it heretofore has been common practice to add wheel support material (to "pad out") to each of both sides of the V-shaped, frog point element starting at the element's ½-inch point location and in a tapered manner extending to either the point element's 3-inch spread location or 7-inch spread location. The material added to each side is essentially tapered from ⅛-inch width at the ½-inch point location to zero width at the applicable point element spread location, and does provide the point element with an increased cross-sectional area at its wheel transfer impact loading zone. However, such addition of wheel support material to each side of the frog point element, while desirably providing for increased point width and increased cross-sectional area at the frog point element zone of wheel transfer impact, unnecessarily complicates the process of machining the assembly's point element flangeways and also undesirably results in changes to the orientation of the point element's true gauge lines to a condition where they are not truly parallel to their respective adjacent frog wing element guard lines.

The extra point material commonly added along each theoretical gauge line reduces the trackwork rail gauge and also becomes a potential obstruction to the passage of wheel flanges. Further, the angle of taper of the added or pad material introduces a new lateral load to the trackwork frog structure. Accordingly, the heretofore common "pad out" modification overall makes the frog design difficult to machine, assemble, install, and gauge.

We have discovered that the standard railroad industry frog may be modified to produce a better so-called heavy point frog capability without adding material to or "padding out" the point element sides and thereby incurring the numerous disadvantages noted above. Such novel modification basically involves adding car wheel support material to increase the width of the frog wing elements at their guard lines rather than increase the width of the point element at its gauge lines. Doing such, while narrowing the width of the separation between the fog wing element guard lines and the frog point element gauge lines within an acceptable limit, does not invoke the penalties associated with the known or prior art frog point heavying modification.

As will be discussed hereinafter, the frog wing element guard line location modification functions to increase the tread surface width of the frog wing element and to simultaneously change the location of the center of the frog point element zone of wheel transfer to a position where the point element has greater width, greater cross sectional shear area, and greater resistance to point element tread surface damage otherwise caused by the impact loads of flanged rail car wheels passing through the frog.

SUMMARY OF THE INVENTION

The railroad frog point assembly of the present invention in a preferred embodiment is basically comprised of a pair of spaced-apart wing rail components, a center body component, and a pair of heel rail components, all components properly and co-operatively joined into a unitary structure. The center body component upon assembly is positioned laterally intermediate the wing rail components, is generally manufactured by efficiently machining a suitable manganese steel casting, and has an end configuration having integrally-formed wing, flangeway, and point elements. The point element is generally V-shaped in planform and each of its principal sides contains a straight gauge line which upon installation of the assembly is a true, straight-line extension of the gauge lines of its continuing heel rail and running rail. The adjacent interior side of each wing element contains a guard line that is parallel in its entirety to the point element straight gauge line. Each side of the point element is separated from its respective adjacent wing element by one of the center body flangeway elements. Also, sides of the assembly wing elements facing directly opposite each other as at the flangeway throat area are in part separated by merged extensions of the center body flangeway elements.

An additional impact load-bearing capability is provided in the assembly by essentially narrowing the center body integral flangeways from a standard width of approximately 1⅞ inch to a reduced width of 1¾ inch throughout a zone extending from the center body throatway to the ends of the integrally formed frog wing elements nearest the formed point element, and such results in the wing element guard line being moved by the difference distance (i.e., ⅛ inch) closer to its respective and parallel point element gauge line.

As a result, the increased tread surface width of each wing element supports the rim tread of a passing car wheel for a greater transition distance and thereby causes the center of the point element wheel transfer impact zone to be displaced relative to that of a comparable conventional "heavy point" frog assembly to a position where the point element cross sectional shear area is larger thereby reducing point element tread surface deformation due to wheel impact loadings.

Other advantages of the present invention will become apparent from a careful consideration of the drawings, detailed description, and claims which follow.

While the foregoing summary basically relates to a railbound type of frog assembly having a manganese steel center body component, the invention also has equal application to solid type frog assemblies wherein the center body wing elements are cast integrally with the wing rail components to thereby eliminate the necessity of joining the wing elements to the wing rail elements as by through bolts as is typically done in the case of railbound type of frog assemblies. Generally, solid-type frog assemblies are more commonly manufactured in a range of smaller frog assembly sizes (A.R.E.A. Sizes Nos. 4 through 12) and are recommended for use at rail intersections involving heavy traffic but only moderate speeds; railbound frog assemblies, on the other hand, are manufactured in sizes extending to A.R.E.A. No. 20 for applications involving both heavy traffic and high train speed turnouts.

DETAILED DESCRIPTION

Figure 1:
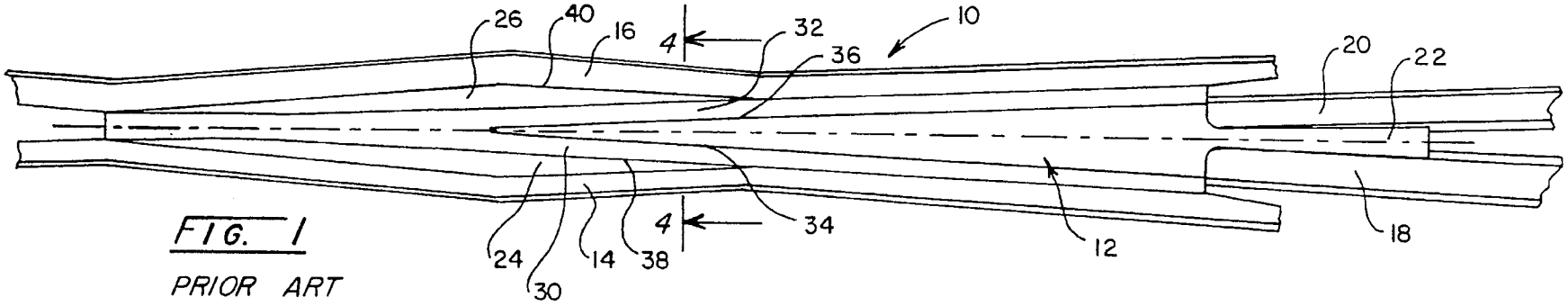
FIG. 1 PRIOR ART
FIG. 1 is a plan view of the principal components of a standard railroad trackwork frog assembly.

FIG. 1 illustrates the principal components of a standard railroad industry trackwork frog assembly 10 which principally is comprised of a center body component 12, a pair of wing rail components 14 and 16, and a pair of heel rail components 18 and 20. Although not shown in FIGS. 1 through 3 of the drawings, threaded fasteners (e.g., bolt and nut combinations) are typically utilized to secure center body component 12 to rails 14 and 16 (and to join heel rail components 18 and 20 to the heel extension portion 22 of center body component 12), such are shown only in FIGS. 4 through 6. Also not shown in the drawings are the necessary tie plates, clips, and other miscellaneous hardware that are typically provided with the components of frog assembly 10 for properly installing the assembly on conventional ties in the incorporating and intersecting running rail (main line) and turnout or crossover rail lines.

Center body component 12 is normally formed from a manganese steel casting that is subsequently machined to have precisely located and integrally formed wing elements 24 and 26, V-shaped point element 28, and flangeways 30 and 32 which are each positioned intermediate point element 28 and their respective wing element 24 or 26. Also, each side of point element 28 has a gauge line 34 or 36, and wing elements 24 and 26 have guard lines 38 and 40. Lines 34 and 36 are each straight, are each parallel to their respective and adjacent counterpart guard line 38 or 40, and extend along the sides of point element. On complete installation, gauge lines 34 and 36 are each a true straight line extension of the gauge lines of their respectively joined heel rail element 18 or 20 as well as being truly parallel to the adjacent-most guard line 38 or 40. For the FIG. 1 frog assembly, the widths between gauge and guard lines of the flangeway elements 30 and 32 are an A.R.E.A. standard distance of 1⅞ inch. The center of the wheel transfer impact zone in the tread surface of point element 28 in the "facing movement" direction is 26.125 inches from the point of point element 28, and point element 28 has a cross sectional area of 4.7569 square inches at that position.

Figure 2:
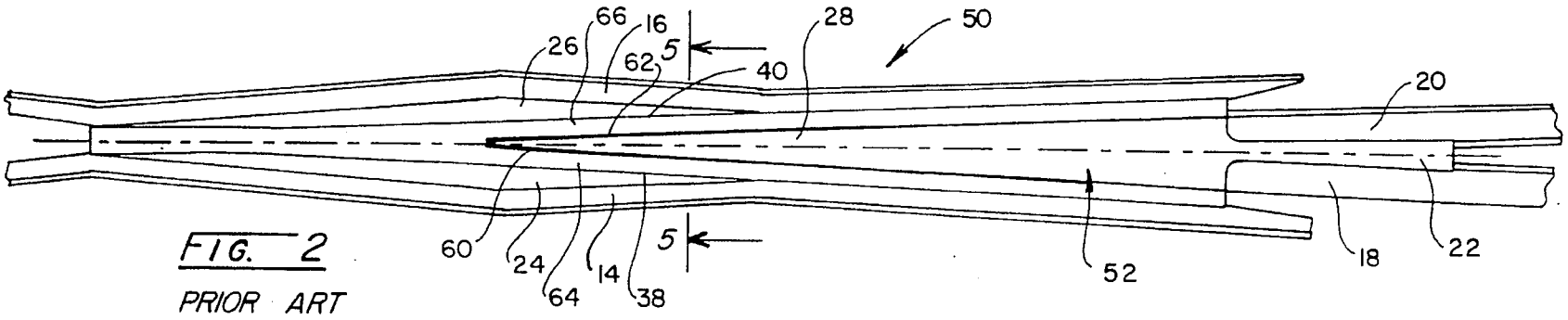
FIG. 2 PRIOR ART
FIG. 2 is a plan view of the principal components of the standard railroad trackwork frog assembly of FIG. 1 as heretofore modified in a known manner to minimize frog point element tread surface impact deformation.
Figure 4:
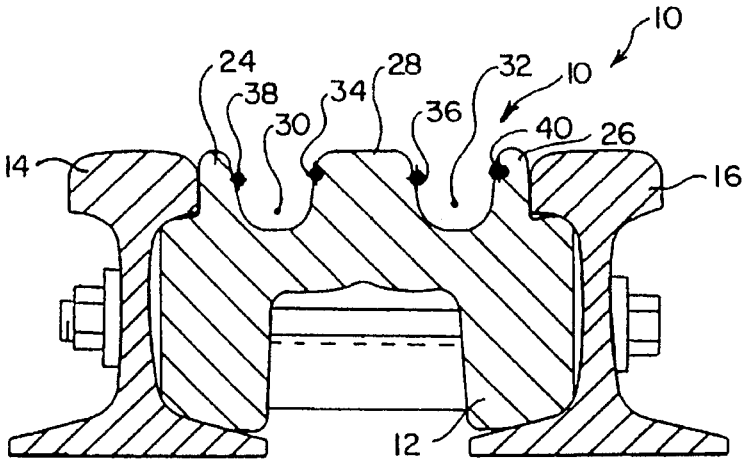
FIG. 4 PRIOR ART
FIG. 4 is a section view taken along line 4—4 of FIG. 1.
Figure 5:
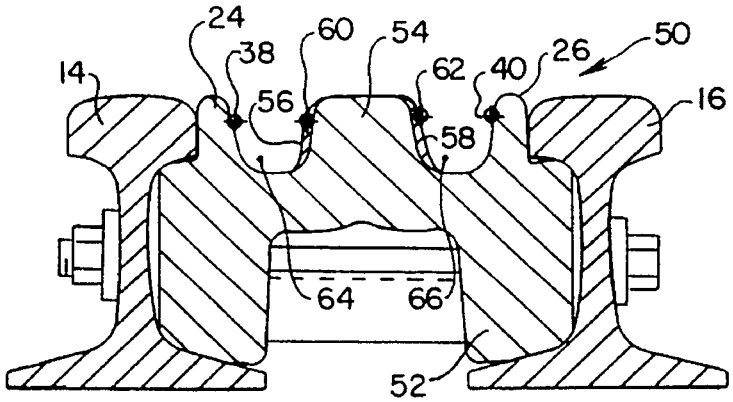
FIG. 5 PRIOR ART
FIG. 5 is a section view taken along line 5—5 of FIG. 2.

FIGS. 2 and 5 are similar to FIGS. 1 and 4 except that they are provided to illustrate a heretofore commonplace modification of the standard frog assembly 10 to provide it with a "heavy point" impact resistance capability. The prior art "heavy point" frog assembly is designated by the reference numeral 50 in the drawings. Wing elements 24 and 26 of center body 52 remain the same as in FIGS. 1 and 4 but the new point element 54 is different than element 28 of FIGS. 1 and 4. More specifically, additional impact-receiving material is provided in point element 54 in comparison to point element 28 and such is shown schematically by the cross-hatched cross-sectional areas designated 56 and 58. Accordingly, new gauge lines 60 and 62 replace gauge lines 34 and 36, respectively. As indicated in the summary provided above, material additions 56 and 58 have a tapered planform which varies the point element 52 width by a distance of approximately ⅛ inch on each side (total of ¼ inch) at the point element ½ inch point location to a zero additional distance at either the point element 3-inch spread location or the point element 7-inch spread location. Although the center of the wheel transfer impact zone moves closer to the point element point location, the width of the point is increased by the "padding". In the case of a prior art heavy point frog assembly having the added material taper from ⅛ inch at the point element ½ inch point location to zero at the 7-inch spread location, the increased width results in a point element cross-sectional area of 5.0621 square inches compared to the above-referenced 4.7569 square inch cross section at the point of full load transfer in the non-heavied standard frog assembly construction. The indicated cross-sectional areas are based on A.R.E.A. No. 11 frog assembly standard planforms.

In the case of the FIG. 2 and 5 assembly, however, it should be noted that gauge line 60 is not truly parallel to guard line and also gauge line 62 is not truly parallel to guard line Such condition is unnecessarily more complex and difficult to machine. Also, the added materials 56 and 58 are potential obstructions to the passing of car wheel flanges through the frog assembly and further can impose unwanted additional lateral loadings on the car wheel flanges. In the FIG. 2, 5 embodiment the modified flangeway elements are designated by the reference numerals 64 and 66.

Figure 3:
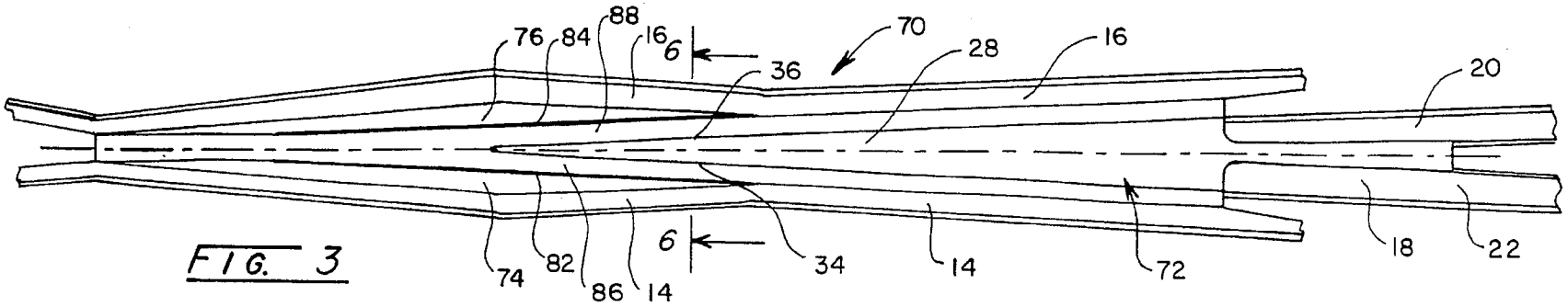
FIG. 3 is a plan view of the principal components of a railroad trackwork frog assembly constructed in accordance with the present invention.
Figure 6:
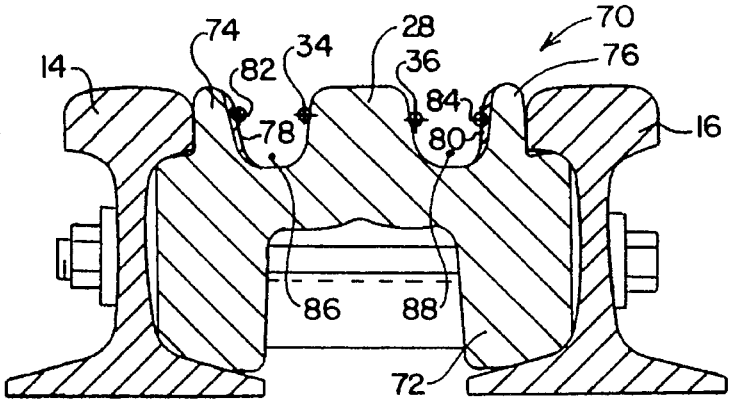
FIG. 6 is a section view taken along line 6—6 of FIG. 3.

To overcome the prior art deficiencies, we provide the frog assembly 70 of FIGS. 3 and 6 which includes a preferred embodiment of the present invention. Assembly 70 includes a center body 72 which is comprised of the same point element 28 as in the prior art assembly construction (FIGS. 1 and 4) but which has different wing elements 74 and 76. In the FIG. 3, 6 embodiment of the assembly center body component the "pad" material is added to the interior sides of wing elements 74 and 76 as shown by the cross-hatched sectional areas 78 and 80. The new wing element guard lines 82 and 84 are each displaced inwardly a uniform distance of approximately ⅛-inch from their FIG. 1, 2, 4, and 5 position and in their new location remain truly parallel to gauge lines 34 and 36 of point element 28. Thus, the machining of flangeway elements 86 and ee remains relatively non-complicated as in the case of the FIGS. 1 and 3 flangeway element embodiments. However, flangeway elements 86 and 88 are each an approximately uniform ⅛-inch narrower than either flangeway element 30 or 32.

Also, and as indicated earlier in this specification, the added impact load bearing material 78 and 80 in essence shifts the point where wheel impact loads are fully transferred from the wing rail elements to the point element tread surface by an additional running distance and such shift is to a location where the point element width is wider and the cross-sectional shear area is larger. In the case of an A.R.E.A. No. 11 frog assembly construction modified according to FIGS. 3 and 6, the load transfer impact zone center becomes 5.1273 square inches in cross-section in comparison to the above reported FIGS. 2 and 5 embodiment cross-section area of 5.0621 square inches. More importantly, however, the ½-inch point location width for point element 28 of center body component 72 remains ½-inch in width, and gauge lines 34 and 36 remain truly parallel to guard lines 82 and 84.

A similar flangeway element and point element improvement may be incorporated into a solid manganese steel frog assembly of the type having the wing rail elements and wing elements combined and case integrally with the point element and included flangeway elements.

Other component shapes, sizes, and materials may be substituted for those specified herein without departing from the scope or spirit of the following claims.

We claim our invention as follows:

1. In a railroad trackwork frog assembly, in combination:

a pair of wing rail components;

a center body component having integrally formed wing elements which each has a guard surface defining a guard line, a V-shaped integrally formed point element having a pair of gauge surfaces defining gauge lines, and a pair of integrally formed flangeway elements positioned respectively intermediate each said guard line and an adjacent one of said gauge lines;

a constant width of padding material applied to each of said wing element guard surfaces defining said guard lines to thereby increase the wheel contact surface area of said wing element and reduce the width of said flangeway elements a uniform distance to support said wheel on said wing element over a greater distance prior to transfer to said point surface, fastener means securing said center body component wing elements to said pair of wing rail components; and each said point element gauge line being oriented truly parallel to its respective adjacent wing element guard line and being uniformly separated from its respective adjacent wing element guard line by a uniform distance of approximately 1¾ inches.

2. In a railroad trackwork frog assembly, an integrally formed body component comprising in combination:

a centrally positioned V-shaped point element having a pair of gauge surfaces defining a gauge line;

a pair of wing rail elements each having a surface defining a guard line and a constant width of padding material applied to each of said surfaces of said wing rail elements; and a pair of flangeway elements which separate each side of said V-shaped point elements from a respective one of said wing rail element gauge surfaces, each said point element gauge line surface being oriented truly parallel to its respective adjacent wing rail element guard line and being uniformly separated from its respective adjacent wing element guard line by a uniform distance of approximately 1¾ inches.

* * * * *